United States Patent [19]

Kock

[11] 4,122,663

[45] Oct. 31, 1978

[54] STOP WATCH AND TIMING DEVICE

[76] Inventor: Bruce A. Kock, 6017 Ocean View Dr., Oakland, Calif. 94618

[21] Appl. No.: 668,086

[22] Filed: Mar. 18, 1976

[51] Int. Cl.[2] ..... G04B 11/00; G04B 27/04; G04F 7/06; G04F 7/08

[52] U.S. Cl. ..... 58/74; 58/73; 58/80; 58/85.5; 58/86; 58/87; 58/117; 58/125 R

[58] Field of Search ..... 58/7-9, 58/46 R, 59, 73, 74, 76-81, 83 R, 85, 85.5, 86, 87, 91, 116 R, 117, 125 R

[56] References Cited

U.S. PATENT DOCUMENTS

| | | | |
|---|---|---|---|
| 1,101,443 | 6/1914 | Howard | 58/85 |
| 1,173,466 | 2/1916 | Teske | 58/85 |
| 1,677,045 | 7/1928 | Odom | 58/87 X |
| 2,443,558 | 6/1948 | Frennesen | 58/85 X |
| 2,532,943 | 12/1950 | Riemer | 58/85.5 |
| 3,210,925 | 10/1965 | Hepler | 58/74 X |
| 3,315,461 | 4/1967 | Eshleman et al. | 58/85 |
| 3,675,413 | 7/1972 | Fluck | 58/74 |
| 3,681,915 | 8/1972 | Kanazawa et al. | 58/117 X |
| 3,785,143 | 1/1974 | Fujimori | 58/91 |
| 3,974,639 | 8/1976 | Gilomen et al. | 58/86 |

*Primary Examiner*—Stanley J. Witkowski
*Attorney, Agent, or Firm*—Victor R. Beckman

[57] ABSTRACT

There is disclosed herein a stop watch and timing device which includes a dial train, escapement, time train, mainspring and barrel, and stop, start and reset means of novel design. The device is readily adapted for construction using inexpensive molded plastic components which are easily assembled with a minimum of time and effort.

49 Claims, 20 Drawing Figures

FIG 5
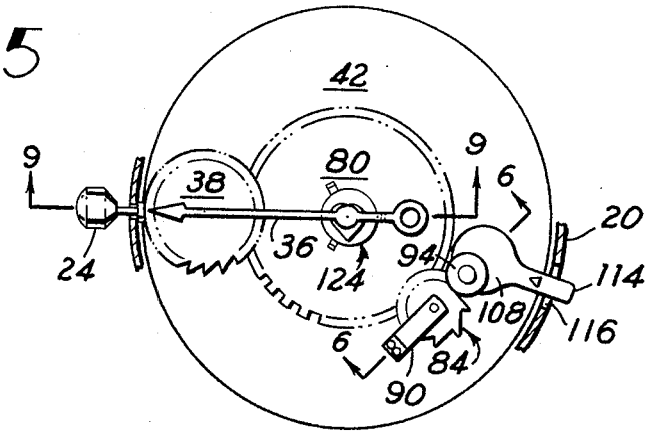
FIG 6
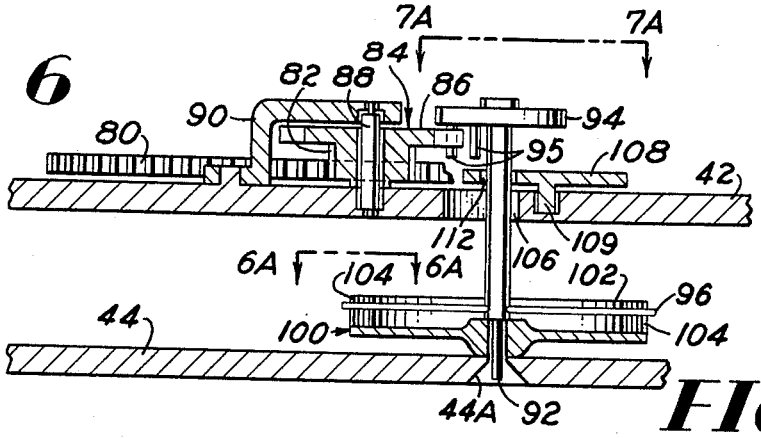
FIG 7B
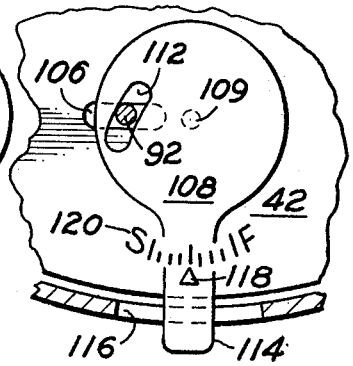
FIG 6A
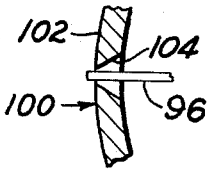
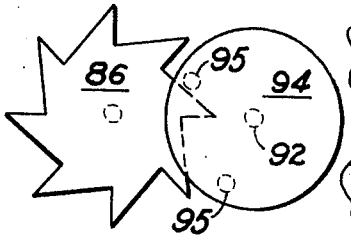
FIG 7A
FIG 8B
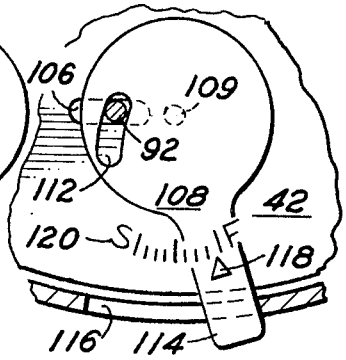
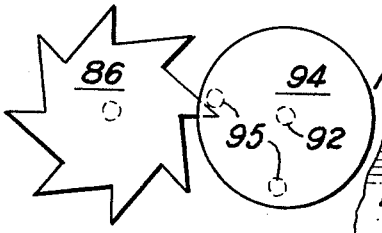
FIG 8A

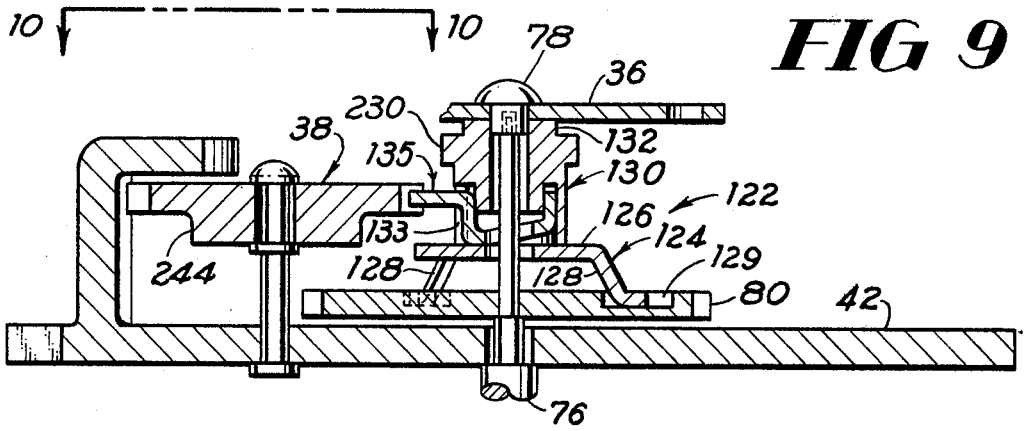
FIG 9
FIG 9A
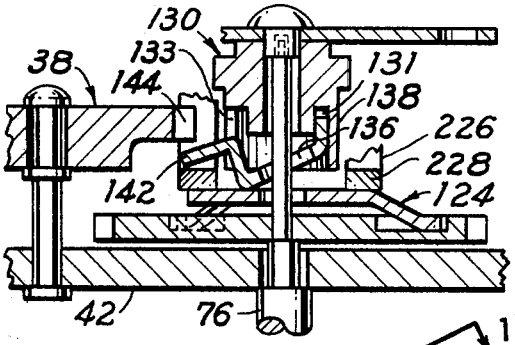
FIG 10
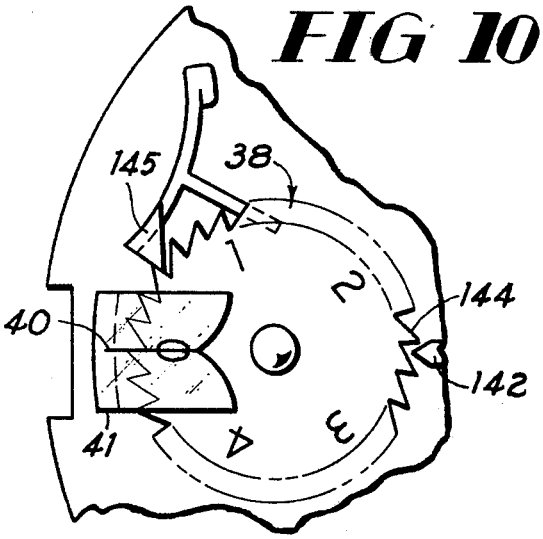
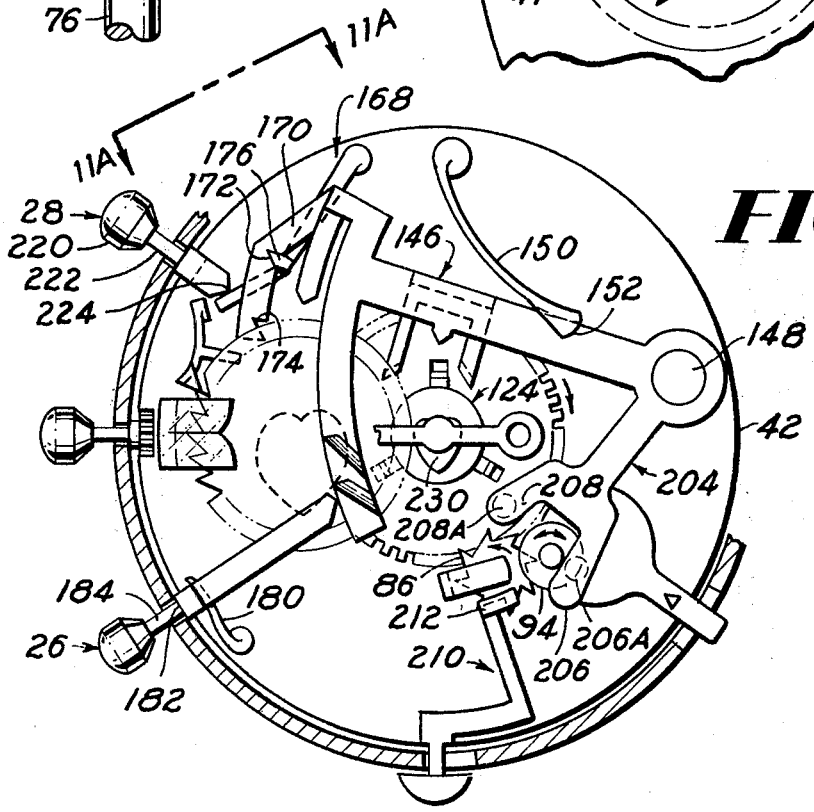
FIG 11

STOP WATCH AND TIMING DEVICE

BACKGROUND OF THE INVENTION

A watch and watch escapement mechanism are shown in U.S. Pat. Nos. 3,613,353 and 3,685,282, respectively, of the present inventor Bruce A. Kock. The watch of U.S. Pat. No. 3,613,353 is of relatively few parts and inexpensive construction. Prior art stop watches and many prior art watches, require the use of many critically dimensioned and located components which are difficult to assemble, all of which contribute to the high cost thereof.

SUMMARY OF THE INVENTION AND OBJECTS

An object of this invention is the provision of a stop watch and timing device having relatively few parts which are easily constructed, as by a molding process, and which parts may be readily assembled with a minimum of time and labor.

An object of this invention is the provision of an attractive stop watch which includes a sweep second hand and a minute dial.

An object of this invention is the provision of a stop watch of simple design which includes a multiple function, multiposition, lever for use in start, stop, and reset operations.

An object of this invention is the provision of a horological instrument which includes a novel up-down indicating means actuated by torque supplied by the instrument mainspring, and which includes means for stopping instrument operation when the torque reduces below a predetermined value.

An object of this invention is the provision of a novel clutch device for use in a horological instrument for coupling the mainspring and barrel to prevent overwinding of the mainspring.

An object of this invention is the provision of an escapement mechanism for a horological instrument which includes a novel leaf spring and balance wheel arrangement together with novel speed regulating means for changing the depth of engagement of escapement pallets with an escape wheel.

An object of this invention is the provision of a novel stop watch or timing device which includes a movable clutch plate between the time and dial trains for the transfer of power from the time train to the dial train.

The novel horological instrument of this invention includes a center wheel, or gear, affixed to a rotatable center shaft having a sweep hand rotatably journalled thereon. The center shaft, which is rotatably supported by spaced front and rear plates, extends upwardly from the front plate, and the center wheel and sweep hand are carried by the upwardly extending portion of the shaft. A driven member rotatably mounted on the rotatable center shaft rotatably supports the sweep hand on the center shaft, and a clutch mechanism releasably connects the driven member to the center wheel for drive rotation of the sweep hand with rotation of the center wheel in the clutch engaged condition. The clutch mechanism includes a generally axially movable clutch member attached to the center wheel which normally is resiliently biased into engagement with the driven member. A clutch actuating mechanism is included for use in disengaging the clutch during reset operation.

Rotatably mounted minute indicating means including a calibrated dial and an associated transparent marker integrally formed with the front plate provide an elapsed minute indicator. The dial is rotatably driven by gathering spring means carried by the rotatably mounted clutch driven member and engageable with teeth formed on the dial. In the clutch-engaged condition, the gathering member engages a dial tooth to advance the dial for each revolution of the sweep hand. In the clutch disengaged condition the gathering spring means moves axially out of alignment with the teeth on the minute dial to permit resetting of the dial.

For stop watch use the instrument includes a unitary, three-position, start (run), stop and reset lever, pivotally attached to the front plate, which is used in the performance of clutch actuating, cam actuating and start-stop functions. To perform such functions the lever is formed with (1) clutch actuating means engageable with the clutch member for disengaging the same from the driven member during reset, (2) first and second cam actuators engageable with cams carried by the sweep second hand and minute dial for returning the same to initial zero positions during reset, and (3) stop means comprising a bifurcated member with a pair of spaced fingers engageable with the watch pallet included in the watch escapement mechanism for stopping watch operation in the stop and reset position of the start, stop and reset lever.

Return spring biasing means are used for urging the pivotal start, stop and reset lever toward reset condition. Pivotal movement of the start, stop and reset lever against action of the spring biasing means is under control of a manually actuated start-stop member extending outwardly from the instrument case. The start-stop member is formed with cam actuating means adapted for engagement with cam means formed on the lever for pivotal movement thereof to said start and stop positions against operation of the spring biasing means.

The lever is held in said start and stop positions by a resiliently biased pawl engageable with a rack formed on the lever. A manually actuated reset member extending outwardly from the case engages the pawl for release of the pawl from the rack portion of the lever upon actuation thereof whereupon the lever is returned by the spring biasing means to the reset position for resetting the watch. A click on the minute dial is released by the lever during reset to free the dial for resetting, which click is returned to operative engagement with the dial upon actuation of the lever to the start position.

The instrument is driven by a spring drive mechanism which includes a spiral mainspring fitted within a barrel wheel rotatably mounted on an arbor which, in turn, is rotatably mounted between the front and rear plates. The inner end of the mainspring is fixed to the arbor and the outer end of the spring is coupled to the barrel through a clutch member comprising a generally C-shaped spring which is inwardly angled at one end for engagement with an outwardly directed hook formed at the outer end of the mainspring. In an unrestrained condition the radius of the clutch member arc is greater than that of the barrel to provide a snug fit between the barrel and arc. Overwinding is prevented by slippage of the clutch member within the barrel as the barrel is rotated during winding. A combination barrel click and up-down indicating means is provided which includes an elongated spring member having one end fixed to or integrally formed with the upper plate at the bottom thereof. One or more teeth are formed on the spring member for engagement with teeth formed on the barrel wheel. The tangential position of the click along the barrel wheel teeth varies depending upon the mainspring torque, and an indicating arm attached to the click extends through the front, or top, plate for indicating to the operator the degree to which the mainspring is wound. In addition, the combination click and up-down indicating means may be provided with stop means adapted for engagement with a wheel in the time gear train to stop operation of the instrument when the torque reduces to a level which might adversely affect the instrument accuracy.

Escapement means for controlling the drive means includes a wheel formed with a pinion gear which engages the center gear. The wheel is provided with an escapement wheel which cooperates with an escape pallet attached to a rotatably mounted balance staff. A balance wheel is rotatably mounted on the balance staff. An elongated spring connected to the staff and loosely engaging diametrically opposite slots in the rim of the balance wheel serves to rotatably connect the staff to the balance wheel, with energy being supplied to the balance wheel through said spring. The end of the staff with the attached pallet is generally translatably movable by rotatably mounted rate adjustment means accessible from outside the watch case for adjusting the depth of engagement between the escape wheel and escape pallet to adjust the speed of operation of the instrument. The balance staff extends through a first elongated slot in the front plate, which slot extends generally radially from the axis of the escape wheel. The rate adjustment means includes a second elongated slot through which the balance staff also extends. The balance staff is moved along the intersecting slots upon rotation of the adjustment means for control of the depth of engagement of the pallet with the escapement wheel. A pointer on the rate adjustment means, in cooperation with a slow-fast scale on the crystal of the instrument provides a visual indication of the speed setting.

The various parts including the front plate may be made of plastic, and spring biasing means may be integrally formed with the top plate.

The above and other objects and advantages of this invention will become apparent from the following specification when read in conjunction with the accompanying drawings.

BRIEF DESCRIPTION OF THE DRAWINGS

In the drawings, wherein like reference characters refer to the same parts in the several views:

FIG. 5 is a top plan view of the escapement mechanism included in the watch, FIG. 6 is an enlarged sectional view of the escapement taken substantially along line 6—6 of FIG. 5, FIG. 6A is a fragmentary view of the balance wheel and spring taken along line 6A—6A of FIG. 6, FIG. 7A is a view of the escape wheel and pallet taken along line 7A—7A of FIG 6 and FIG. 8A is similar to FIG. 7A but showing a different depth of engagement between the escape wheel teeth and pallet, FIGS. 7B and 8B are fragmentary sectional views showing the speed regulating plate in the escapement mechanism at different settings, FIG. 9 is an enlarged vertical sectional view showing the dial train and the clutch for coupling the time train to the dial train, FIG. 9A is a fragmentary sectional view showing the clutch in disengaged condition, FIG. 10 is a fragmentary top plan view of the minute dial and associated click taken along line 10—10 of FIG. 9, FIGS. 11, 12 and 13 are top plan views showing the start, stop reset lever in start, stop and reset positions, respectively.

Figure 1:
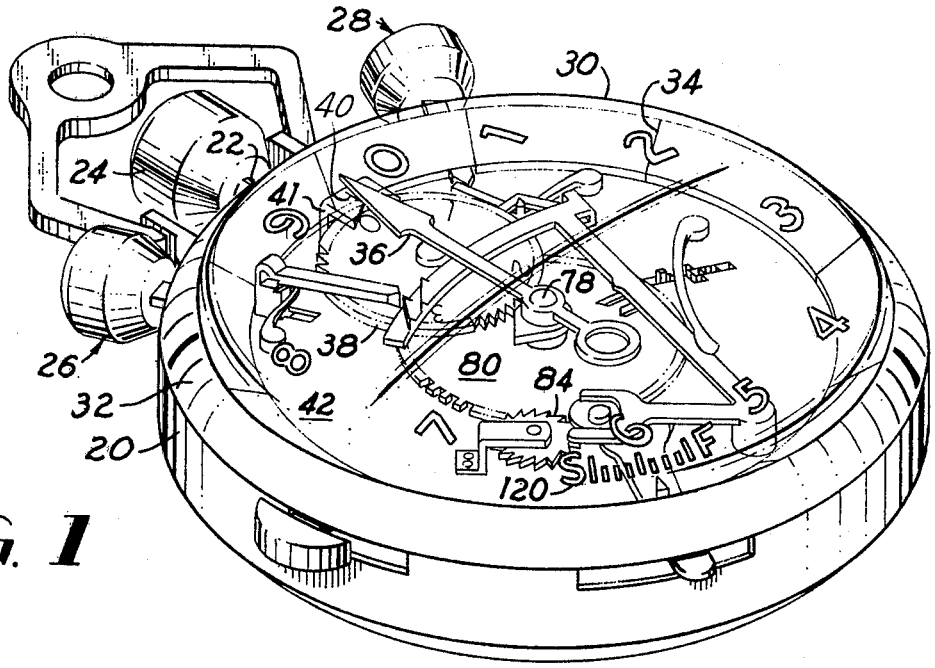
FIG. 1 is a perspective view of a novel stop watch embodying this invention.

For purposes of disclosure a stop watch is shown in the drawings and described below. It will be apparent, however, that various aspects of the invention are applicable to horological instruments in general and are not limited to use in a stop watch. For example, the escapement and associated regulation mechanism, the mainspring and barrel, the up-down indicator, and the like, may be employed with various types of watches, timing devices, and the like, without limitation to the illustrated stop watch.

Reference first is made to FIG. 1 wherein a stop watch embodying this invention is shown comprising a watch case 20 from which a winding stem 22 having an integrally formed crown 24 extends for winding the watch. Also extending from the case are a start-stop push button actuating means 26 for starting and stopping operation of the watch, and a reset button actuating means 28 for resetting second and minute time indicating means to zero following a timing operation. A crystal 30 with an attached bezel 32 removably secured to the case covers the front of the same. The bezel is provided with a sloping inner face 34 comprising a dial plate visible through the crystal and calibrated in terms of 1/10th seconds for cooperation with a sweep second hand 36. In the illustrated arrangement the scale for the second hand 36 is calibrated from 0 to 10 seconds, with numerals being located on the crystal 30. A minute indicator, comprising a rotatable dial 38, is calibrated from 0 to 5 minutes, and a fiducial line 40 on a transparent fiducial plate 41 provides a reference from which the minute dial is read. In the illustrated arrangement the fiducial plate 41 is integrally formed with the front, or top, plate 42 of the stop watch. Although the above-described 1/10th second and minute calibrations have been found to be convenient, it will be apparent that the stop watch is not limited thereto, and is readily modified for use with differently calibrated scales if desired.

Figure 2:
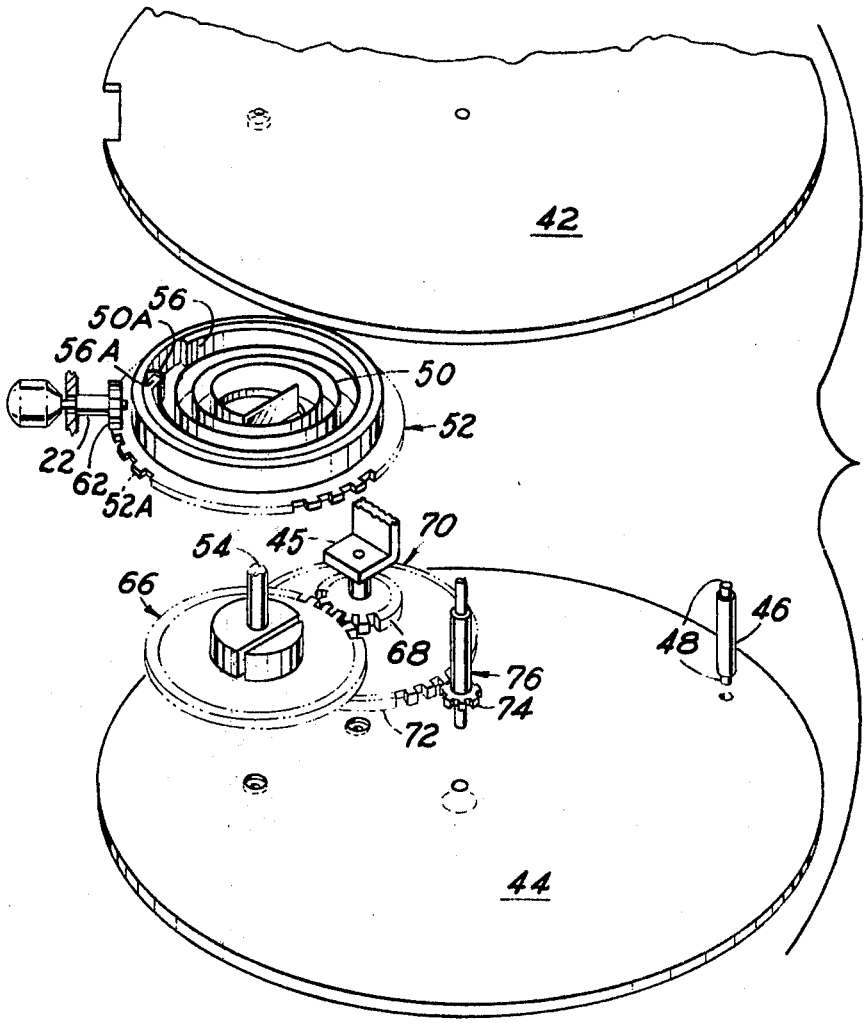
FIG. 2 is an exploded view showing the mainspring drive mechanism for the stop watch.

Referring to FIG. 2 the novel stop watch includes front and rear plates 42 and 44 secured a spaced distance apart by means of posts 46 extending therebetween. Fastening means such as snug, friction-fit, connecting means 48 may be used to secure the plates to the opposite ends of the posts. The watch is driven by a spring drive mechanism which includes a spiral mainspring 50 fitted within a barrel wheel 52 rotatably mounted on an arbor 54 which, in turn, is rotatably mounted between the front and rear plates 42 and 44. The inner end of the mainspring is fixed to the arbor as by means of a cooperating hook and slot arrangement. To limit the degree of tightness to which the mainspring 50 may be wound, the outer end of the spring is coupled to the inside perimeter of the barrel wheel through a generally C-shaped clutch member 56. An outwardly directed U-shaped end 50A is formed at the outer end of the mainspring for engagement with an inwardly sloped end 56A formed on the clutch member. As seen in FIG. 2, the barrel wheel 52 is formed with a smooth inner cylindrical surface for slidable engagement with the clutch member 56. The clutch member is formed of stiffer spring material than the mainspring and in the unrestrained condition thereof, e.g. when removed from the barrel, the radius of curvature is greater than that of the inside radius of the barrel to provide a snug fit between the barrel and curved clutch member. In use, with the one end 56A of the clutch member in engagement with the outwardy directed U-shaped end, or hook, 50A on the mainspring, there is positive rotative pushing engagement of the clutch 56 by the mainspring 50 in one relative direction of rotation thereof. Therefore, it will be apparent that at some predetermined mainspring tension, as the watch is being wound, the clutch member 56 will slide along the inside perimeter of the barrel 52 without further tightening of the spring as the barrel is rotated to thereby prevent overwinding. Smooth clutch action is provided by this arrangement.

Figure 3:
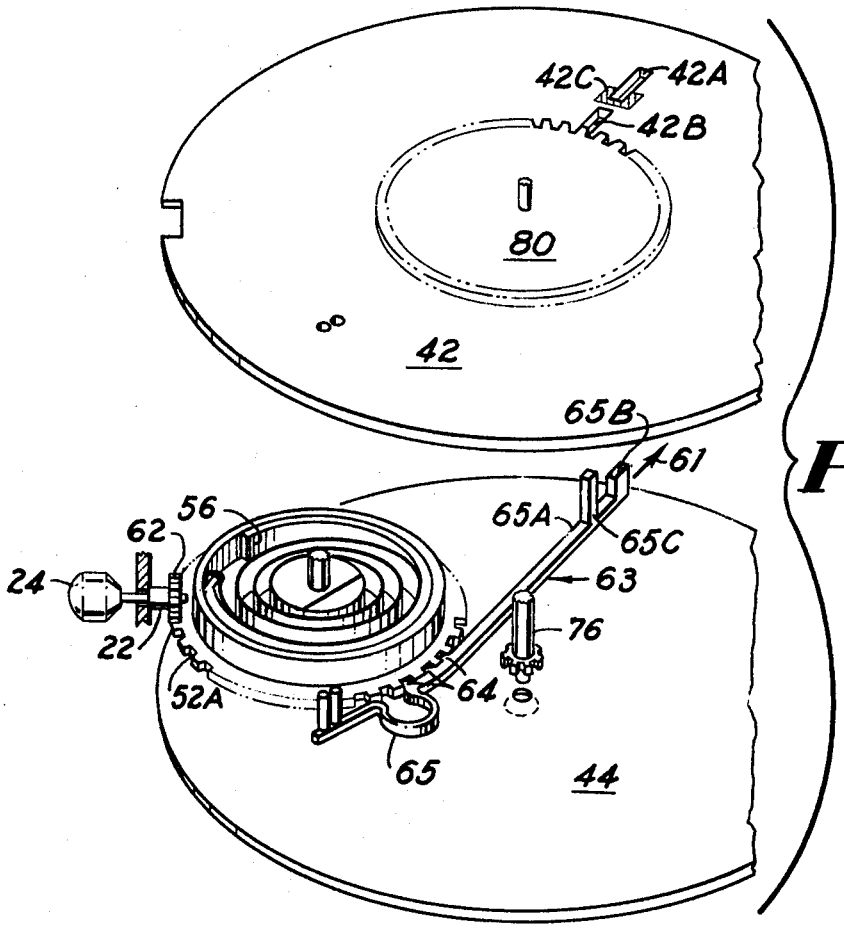
FIG. 3 is a perspective view of an up down indicator and associated stop means for stopping watch operation under low torque conditions.

The winding mechanism includes a pinion gear 62 formed on the winding stem 22, which gear engages teeth 52A formed on the barrel wheel. Rotation of the crown 24 in one direction drives the barrel wheel in a direction to wind the mainspring. Rotation of the barrel in the opposite direction is prevented by means of a click included in a novel combination click and up-down indicator mechanism 63. As best seen in FIG. 3, the click includes one or more teeth 64, three teeth being shown formed on a leaf-type spring 65 portion of the mechanism 63, one end of which spring is integrally formed with or suitably, attached to the bottom, or rear, of the top, or front, plate 42. The click teeth 64 engage the teeth 52A formed on the main spring barrel to permit rotation of the mainspring barrel in one direction only during winding. The associated up-down, mainspring torque, indicating means and low torque stop means include an arm portion or extension 65A at the free end of the spring 65, which extension is formed with an upwardly directed end which extends through a slot 42A formed in the top plate 42. (See also FIG. 4) Guided by the slot, the arm is free to move in a generally longitudinal direction. In the tightly wound condition the mainspring torque transmitted to the arm through the click 64 moves the arm in the direction of arrow 61, and as the torque decreases, during operation, the arm moves in the opposite direction. The up-down indicator 63 is resiliently biased by spring 65 for movement in one direction opposite arrow 61. Means including the click 64 and mainspring barrel teeth 52A, which interconnect the resiliently biased up-down indicator 63 and mainspring 50, provided for balancing force provided by the mainspring 50 torque against the resiliently biased up-down indicator 63 for movement of the indicator 63 in an amount related to the mainspring 50 torque for visual indication of said mainspring 50 torque over a range of mainspring torque. It will be seen, then, that the click 64 of the up-down indicator 63 is movable in an amount which is a function of the mainspring torque, the greater the torque, the further the up-down indicator is moved in the direction of arrow 61. Consequently, the relative position of the top, or head, 65B of the upwardly extending arm end within the slot 42A provides a visual indication of the mainspring torque. A portion 42C of the top plate adjacent the "low torque" end of the slot 42A may be provided with a distinctive color, e.g. red, and the head of the arm may be of the same color. When the head enters the red area 42C, a low torque condition is indicated which is readily observable, indicating to the operator that rewinding of the watch is required. To prevent operation of the watch under such low torque conditions a stop member 65C may be formed on the arm 65A which extends through a slot 42B in the top plate, which member is adapted for engagement with a center gear 80 in the time train to stop the watch when the mainspring torque reduces to a predetermined level. As is well understood, accuracy is improved where watch operation over a limited mainspring torque range is provided. With the present arrangement an upper torque limit is set by use of the clutch mechanism 56, and a lower torque limit is set by use of the stop 65C included in the torque indicating means.

Continuing with a description of the time train. (FIG. 2) the mainspring arbor 54 is shown integrally formed with an arbor wheel 66 which engages a pinion portion 68 of a second gear 70. The second gear also includes a large gear portion 72, and shaft ends rotatably supported between a bridge, or bracket, 45 integrally formed at the bottom of the front plate 42, and the rear plate 44. The large gear portion 72 engages a pinion gear portion 74 affixed to a center shaft 76, one end of which shaft is rotatably supported in the rear plate 44. The shaft 76 extends through the front plate 42 in which it is rotatably journaled, and is provided with a cap 78 (FIG. 1 and 9) at the upper end thereof. A large, center, gear 80 is attached to the center shaft 76, which gear is positioned to the front of the front mounting plate 42. The gear 80 engages a pinion gear 82 of a wheel 84 which wheel includes an escape wheel 86 included in the novel escapement mechanism embodied in the horological instrument of my invention.

From the description thus far, it will be seen that the horological instrument of my invention includes a mainspring 50, and a time train connecting one end (the inner end in the illustrated arrangement) of the mainspring to the escapement comprising the wheel 84. In brief, the time train for connecting the inner end of the mainspring 50 to the escapement includes the arbor 54 to which the inner end of the mainspring 50 is fixed by means of a cooperating hook and slot arrangement best shown in FIG. 2. The arbor 54 is integrally formed with an arbor wheel 66 which engages a pinion portion 68 of a second gear 70. The gear 70 includes a large gear portion 72 which engages a pinion gear portion 74 fixed to the center shaft 76. A large center gear 80 attached to shaft 76 engages a pinion gear 82 of the wheel 84 which, as noted above, is included in the escapement mechanism.

The winding mechanism, as described above, includes the barrel wheel 52 connecting the outer, hooked, end 50A of the mainspring 50 to the winding stem 22 (through novel clutch member 56). Also, as described above, a winding click 64 is engagable with teeth 52A on the barrel wheel 52 for limiting relative wheel 52 and click 64 rotation to one rotary direction.

Figure 4:
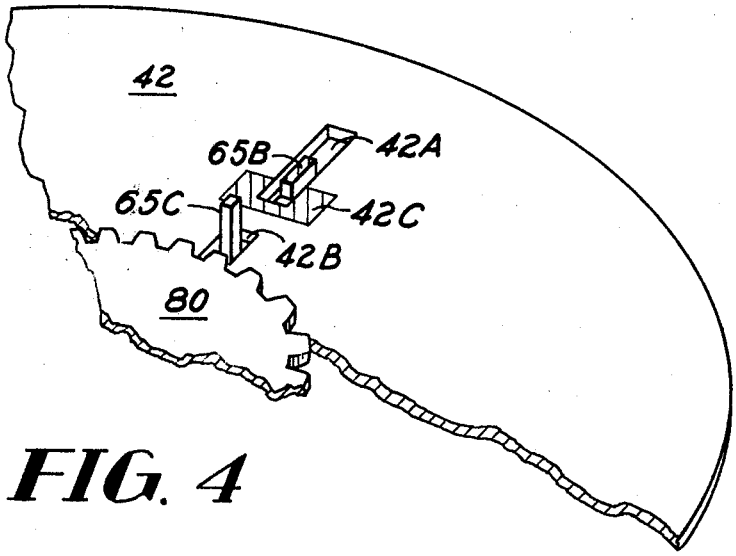
FIG. 4 is a fragmentary perspective view of the top plate showing the up down indicator and stop means shown in FIG. 3 extending therethrough.

Resilient biasing means 65 are included for mounting the winding click 64 for limited movement along a path extending generally tangentially of said wheel 52 (in the direction of arrow 61) whereby the force provided by the mainspring 50 torque on the click 64 is opposed by the resilient biasing means 65. Up-down indicating means 63 on the winding click 64 (integrally formed therewith) provides a visual indication of the mainspring torque through observance of the position of the end 65B within the slot 42A (FIG. 4.)

As best seen in FIGS. 5 and 6, the wheel 84 (comprising the pinion 82 and escape wheel 86) is rotatably mounted on a stud, or post, 88 extending between the front plate 42 and a raised bracket 90 attached to the upper surface of the front plate. A rotatably mounted balance staff 92 extends generally parallel with the escape wheel post 88, and a novel mounting means for the staff for timing adjustment is described below. For present purposes it will be seen that the staff 92 has an escape pallet 94 affixed thereto at the upper end thereof above the front plate 42. The pallet 94 is formed with a pair of downwardly extending lugs or pins 95 which engage the escapement wheel 86. Also attached to the staff 92, beneath the front plate 42, is a leaf-type or elongated cylindrical shaped spring 96 with radially, diametrically oppositely, extending spring end portions which cooperate with a balance wheel 100. The balance wheel 100, which is generally cup-shaped, is rotatably mounted on the staff 92. The rim 102 of the cup-shaped balance wheel is formed with a pair of diametrically opposite slots 104 into which the outer free ends of the balance springs 96 freely extend. The slots are formed with tapered, angled, or curved slot walls for line or point, engagement of the spring end therewith. (See FIG. 6A.) Bending of the spring ends by simultaneous engagement with opposite wall surfaces is thereby avoided to avoid unnecessary energy loss within the spring and damping of the balance wheel operation. For purposes of illustration only, inwardly tapered slot walls are shown in FIG. 6A. As noted above, other slot wall configurations may be used including convex, V-shaped, outwardly tapered arrangements, and the like. The essentially line or point contact between the spring ends and walls also serves to reduce the sliding friction between the walls and leaf or cylindrical shaped spring.

The upper end of the staff 92 with the attached pallet 94 is translatably movable by rate adjustment, or regulation, means accessible from outside the watch case whereby the depth of engagement of the pallet lugs 95 with the teeth on the escape wheel 86 is adjustable for rate, or speed, adjustment of the instrument. As seen in FIGS. 6, 7B and 8B, the rate adjustment means includes an elongated slot 106 formed in the front plate 42. The slot extends radially from the axis of the escape wheel supporting post 88, and has a width which is slightly greater than the diameter of the staff 92 extending therethrough. A speed adjusting plate 108 is pivotally mounted on a post 109 adjacent the top of the front plate 42, and is formed with a generally spiral slot 112 which intersects the slot 106 in the top plate and through which the staff 92 extends. The spiral slot 112 also is of a width which is only slightly greater than the diameter of the staff 92 extending therethrough. It will be seen then, that when the plate 108 is rotated, the staff 92 is moved along the slot 106 for movement of the pallet 94 toward or away from the escape wheel 86 for slowing or speeding operation of the watch; operation being minimum at maximum engagement and increasing as the pallet is moved away from the escape wheel for a decreased depth of engagement. To allow for tilting of the staff 92 by the speed adjusting means, a tapered hole 44A (FIG. 6) is formed in the bottom plate within which the lower end of the staff is journaled. In the FIG. 7A and 7B position of the regulating means the pallet and escape wheel teeth are at a greater depth of engagement than in the FIG. 8A and 8B position thereof.

The speed adjustment plate 108 is integrally formed with a regulator arm 114 which is accessible through an aperture 116 in the side of the watch case for ease of speed regulation by the user. A pointer 118 on the plate cooperates with slow-fast indicia 120 on the watch crystal for calibrating the same.

Referring to FIG. 9, the dial train for the novel stop watch includes a clutch, identified generally by reference numeral 122, which includes interengagable, movable, drive clutch member 124 and an annular driven clutch member 130. The movable clutch member 124, made of spring sheet material, or the like, comprises an annular disc portion 126 having arms 128 extending from the rim of the disc for attachment to the center wheel 80. In the illustrated arrangement the arm ends are positioned in radially extending elongated grooves 129 formed in the upper face of the center wheel to prevent relative rotary movement of the member 124 and center wheel 80 and, at the same time, allowing relative radial movement of the arm ends along the grooves during clutch actuation. The movable clutch member 124 normally engages the driven clutch member 130 for drive rotation thereof when the clutch member 124 is rotated upon rotation of the center wheel 80. The driven clutch member 130 is attached to, or integrally formed with, an elongated sleeve, designated generally by the reference numeral 132, which sleeve is rotatably mounted on the center drive shaft 76. The sweep second hand 36 is attached to the sleeve adjacent the outer end thereof as by a tight frictional engagement therewith. The cap 78 at the end of the drive shaft 76 limits upper axial movement of the sleeve 132 on the shaft 76, acting as a thrust bearing thereat.

The cooperating surfaces of the movable and driven clutch members 124 and 130 may be formed with radially extending teeth, not shown, for substantially positive drive engagement therebetween to prevent relative slippage as the drive member rotates. As noted above, the movable drive member 124 is formed of a resilient material, such as spring sheet metal, and is thereby normally resiliently biased into clutch-engaged condition with driven member 130. It will be seen, then, that with the clutch 122 in engaged condition, and the stop watch running, the sweep second hand 36 is rotated an incremental amount each time the escape wheel 86 steps. In the illustrated arrangement the combination of gears and gear teeth employed provide for one revolution of the second hand 36 every ten (10) seconds, and the scale 34 is marked accordingly. The clutch members 124 and 130 are disengaged, in a manner described below, and as shown in FIG. 9A, for resetting the watch to zero. Before describing the resetting mechanism, the dial train for the minute indicating dial 38 will be described.

Referring to FIGS. 9 and 9A the minute indicator drive member identified generally by the reference numeral 135, comprises an integral spring member which includes an annular base 136 with a large center opening to avoid engagement with the center shaft 76 which extends therethrough. A mounting tab 138 is formed on the base for friction tight engagement with a groove 131 formed in the driven member 130. Diametrically opposite the mounting tab a gathering arm 142 is formed which includes a generally radially extending portion adapted for engagement with ratchet teeth 144 formed on the periphery of the dial 38. A slot 133 is formed in the sleeve 132 diametrically opposite the groove 131 to accommodate the gathering arm 142. The member 135 is formed of a resilient material, such as spring sheet metal, and is shaped such that the rear, or bottom, of the base portion 136 thereof adjacent the gathering arm 142 is resiliently biased rearwardly (downwardly) into engagement with the movable clutch member 124. Consequently, when the clutch member 124 is moved rearwardly into clutch disengaged position the base 136 and gathering portion 142 pivot rearwardly about the mounting tab 138. With the clutch fully disengaged, rearward movement of the gathering portion 142 of the dial drive means 135 is sufficient to move the same out of alignment with the teeth 144 on the dial 38 to prevent interference with the dial during reset operation.

In the clutch 122 engaged condition the drive, or gathering, arm 142 is engageable with the ratchet teeth 144 formed at the periphery of the dial 38 for drive actuation thereof for each complete revolution of the sweep second hand 36. A spring biased click, or detent 145 (see FIG. 10) releasably locks the dial 38 at the stepped positions. As noted above, in the clutch 122 released, or disengaged, condition the gathering arm 142 drops rearwardly behind the level of the teeth 144 on the dial to avoid engagement of the arm with the teeth.

The mechanism for starting, stopping, and resetting the stop watch, shown in FIGS. 11, 11A, 12 and 13, will now be described, which mechanism includes a three-position lever 146 pivotally mounted on a forwardly extending post, or stud, 148 at the front of the front plate 42. The lever is resiliently biased in a counterclockwise direction about the post, as viewed from the front, by a leaf spring 150 attached to or, as shown in the drawings, integrally formed with the top plate. A laterally extend-portion 152 formed adjacent the end of the spring 150 overlies the start, stop and reset lever 146 to prevent disengagement thereof from the mounting post 148. The lever 146 is shown in run, stop and reset positions in FIGS. 11, 12 and 13, respectively.

Actuation of the lever 146 in a clock wise direction against action of the spring 150 is effected by manual depression of the start stop acutating means 26. Releasable detent means, identified generally by the reference numeral 168, are used to hold the three position start, stop and reset lever in the run (FIGS. 11 and 11A) and stop (FIG. 12) positions against the action of the arm return spring. The releasable detent means includes a rack 170 formed on the lever 146 and having a pair of pawl receiving depressions 172 and 174 formed along one edge thereof. A pivotally mounted pawl, or detent 176 is adapted for engagement with the rack 170. The illustrated pawl 176 comprises a resilient arm integrally formed with the top plate and biased into engagement with the rack in the run and stop positions of FIG. 11 and 12. Alternatively, the pawl simply may comprise a pivotally mounted member resiliently biased in the pawl engaged direction. In the run and stop position, illustrated in FIGS. 11 and 12 the pawl engages the notches 172 and 174, respectively, to prevent counterclockwise rotation of the lever 146 by the spring 150.

Figure 14:
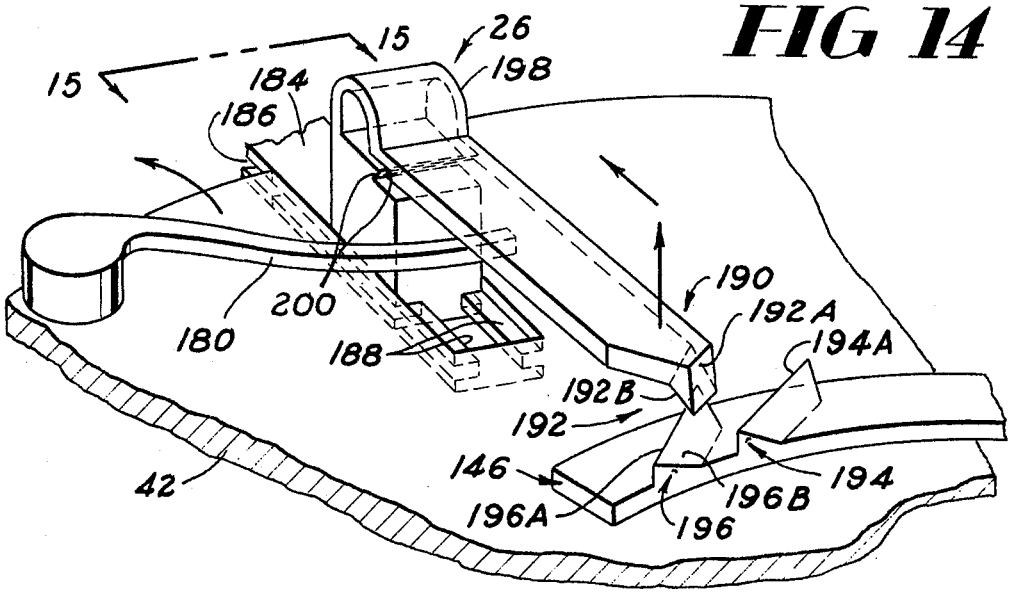
Figure 15:
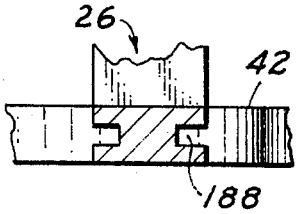
Figure 11A:
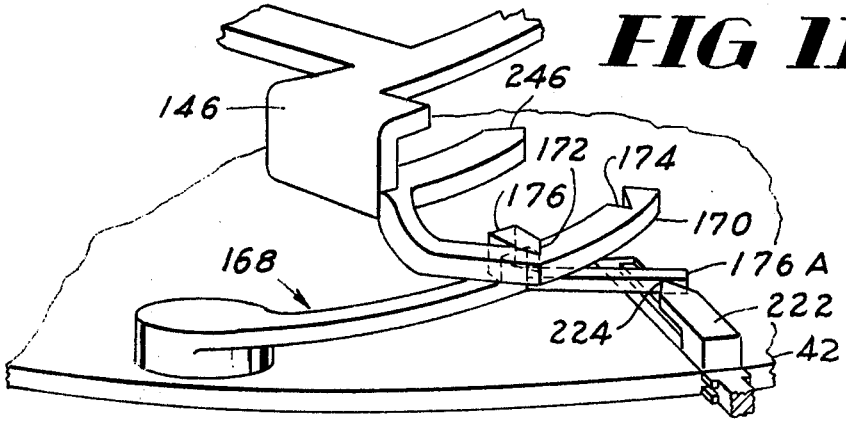
FIG. 11A is an end view of the lever taken along line 11A—11A of FIG. 11, and FIGS. 14 and 15 are enlarged perspective and sectional views, respectively, of the start stop actuating means.

As noted above, actuation of the lever 146 in a clockwise direction is effected by operation of the manually operated start stop actuating means 26. A spring 180 which is attached to or, as shown, integrally formed on the front plate 42, engages the actuating means 26 to normally resiliently bias the same in an outward direction from the watch case. A shoulder 182 on stem 184 of the actuating means is engageable with the inner case wall to limit outward movement of the actuating means 26. As best seen in FIGS. 14 and 15, grooves, 186 are formed in opposite sides of the stem portion 184 for engagement by rails 188 formed in a slot in the top plate 42 for axial slideable support of start stop actuating means 26. During assembly, the actuating means 26 simply is inserted into the railed slot before placement of the mechanism in the watch case.

Figure 12:
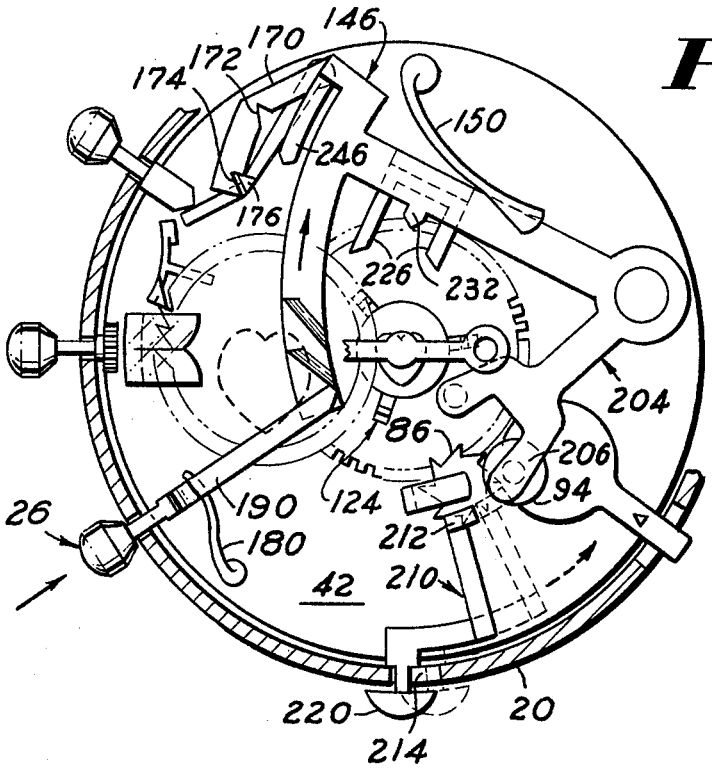
Figure 13:
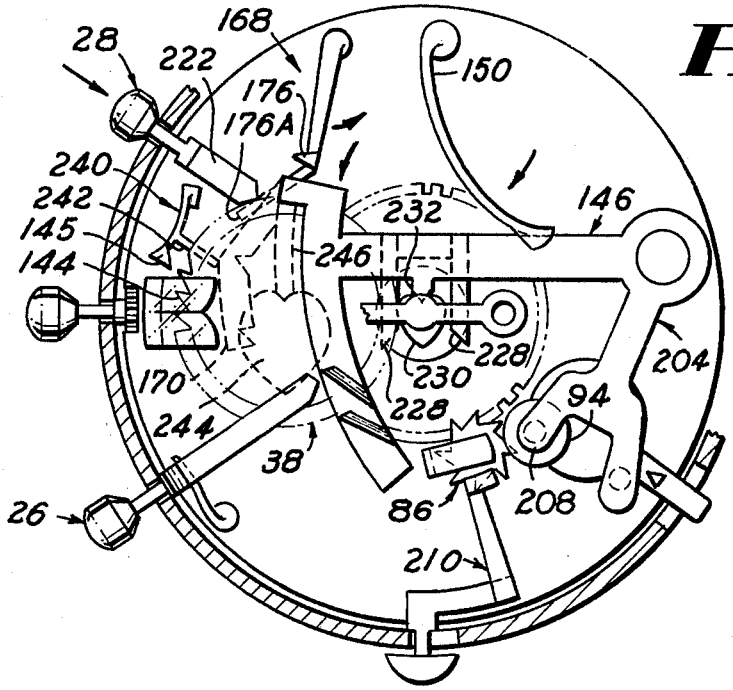

The inner end of the start stop actuating means 26 is provided with a cam actuator 190 formed with a downwardly protruding obliquely angled, cam actuating member 192 at the inner end thereof. An obliquely angled cam actuating surface 192A is formed at the outer free end of the cam actuating member 190 adapted for engagement with cam surfaces 194A and 196A formed by cams 194 and 196 extending from the top surface of the lever 146 (FIGS. 11, 12 and 13). The cam surfaces 194A and 196A, which extend generally perpendicularly from the face of the lever, are engagable by the cam actuating surface 192A on actuating member 190 for clockwise rotation of the lever 146. For example, with the lever 146 in the reset position illustrated in FIG. 13, the cam actuating surface 192A engages the cam surface 194A on the lever when the actuating means 26 is depressed to urge the lever in a clockwise direction against the action of the spring 150 thereby moving the lever from the reset position (FIG. 13) to the run position (FIG. 11). In the run position, the pawl 176 engages the notch 172 in the lever to maintain the lever thereat. Upon release of the stop start actuating means 26 the bottom face 192B of the downwardly protruding cam actuating member 190 (FIG. 14) rides up an inclined surface 196B of cam 196. Upon reaching the end of the surface, the member springs downwardly and the start stop actuator 26 stops with the cam actuating surface 192A adjacent the cam surface 196A in preparation for subsequent stop actuation of the start stop actuating means. It will be seen, then, that when the start stop actuating means 26 is again depressed, the cam actuating surface 192A now will engage the cam surface 196A of cam 196 to further rotate the lever 146 into stop position illustrated in FIG. 12. In FIG. 12 the start stop actuating means 26 is shown in the depressed condition with the cam and cam actuating surfaces 196A and 192A, respectively, in engaged condition.

As seen in FIG. 14, the outer stem portion 184 and inner cam actuating portion 190 of the actuating means 26 are connected through a resilient loop 198 for flexibility in the up and down directions to allow for movement of the cam actuating member 192 formed thereon up the inclined surface 196B of the cam 196. In the illustrated arrangement the various portions of the start stop actuating means including the stem 184, cam actuating portion 190 and loop spring 198 are integrally formed, as by an injection molding process. As seen in FIG. 14, cooperating shoulders 200 and 202 are formed on the stem and actuator portions, respectively, of the actuating means which shoulders abut during the start and stop actuation of the actuating means to limit flexing of the resilient loop 198 in the direction of movement of the actuating means, and to provide the necessary lateral rigidity for actuation of the lever 146 against the resilient biasing action of the spring 150.

The lever 146 is provided with an integral arm portion 204 formed with a bifurcated end having a pair of fingers 206 and 208 which extend over the pallet 94. Rearwardly extending protrusions 206A and 208A are formed on the bottom surfaces of the fingers 206 and 208, respectively, which protrusions are adapted for engagement with a central upwardly extending hub formed on the pallet in the stop and reset positions, respectively, of the lever. In the run position illustrated in FIG. 11 the fingers 206 and 208 of the arm 204 straddle the hub with the protrusions out of engagement therewith whereby the pallet is free to oscillate. In the stop (FIG. 12) and reset (FIG. 13) positions the protrusions 206A and 208A, respectively, are adapted to engage the hub to prevent watch operation.

It here will be noted that a manually actuatable time out control mechanism 210 may be included, as seen in FIGS. 11, 12 and 13, for release of the finger 206 from the pallet when the lever 146 is in the stop position illustrated in FIG. 12. Only the finger 206, which is longer than finger 208, is engagable by the end 212 of the time out mechanism. The mechanism 210 is circumferentially slidably mounted within an elongated groove 214 formed in the case and is movable between the illustrated stop position (FIGS. 11 and 12) and a counter clockwise rotated run position. In FIG. 12, wherein the lever 146 and time out control mechanism 210 both are in their respective stop positions, there is no engagement of the end 212 of the mechanism 210 with the stop finger 208. The watch therefore is stopped with the finger 208 in engagement with the pallet. The watch is restarted without first resetting the same, simply by sliding the time out mechanism counterclockwise. The end 212 of the mechanism thereupon engages the finger 206 thereby lifting the same off the pallet allowing the resumption of watch operation. It will be seen, then, that with the lever 146 in the stop position (FIG. 12) start and stop control of the watch is provided by means of the time out control mechanism 210 without watch resetting. Consequently the watch may be employed as an accumulated time indicator, if desired.

As mentioned above, the detent 176 is released from engagement with the rack 170 by actuation of the reset actuating mechanism 28. The illustrated reset mechanism includes a head 220 formed at the outer end of a reset shaft 222 formed with a V-shaped inner end 224 for engagement with an extension 176A formed on the pawl, or detent, 176. The same type of slot, rail and groove mounting means for the start stop actuating means 26 shown in FIGS. 14 and 15 and described above may be used for the reset actuating means 28. As noted above, the pawl 176 is included as a part of a resilient arm integrally formed with the top plate 42, the resiliency of which arm normally urges the actuating means 28 outwardly. It will be seen, then, that when the reset actuating means 28 is depressed, the pawl 176 is pivoted in a counterclockwise direction, as viewed from the front, to release the same from the rack 170. From the stop position of the lever 146 illustrated in FIG. 12, the lever is freed upon actuation of the reset actuating means 28 for return pivotal movement to the FIG. 13 reset position by operation of the spring 150.

Return of the second and minute indicators 36 and 38, respectively, during such return movement of the three position lever 146 from the stop position (FIG. 12) to the reset position (FIG. 13) in preparation for a subsequent timing operation now will be described. Note first that in the return of the lever 146 to reset position the drive train is stopped by movement of the finger 208 on the lever into engagement with the pallet. Substantially simultaneously therewith, the dial train connection is broken by actuation of the clutch 122 from the clutch engaged condition (FIG. 9) to the clutch released condition (FIG. 9A). As noted above, the movable clutch member 124 normally engages the driven clutch member 130. Disengagement of the clutch members is effected by means of clutch release arms 226 formed on the three position lever 146. As the lever 146 pivots toward the reset position under action of the spring 150 the clutch release arms 226 engage the movable clutch member 124. The clutch release arms are formed with beveled edges 228 which engage the movable clutch member to urge the same rearwardly, or downwardly, into clutch disengaged condition. As described above, in the clutch released condition the gathering pawl, or arm, 142 pivots rearwardly out of any possible engagement with the ratchet wheel teeth 144 on the minute dial 38.

After disengagement of the clutch 122 by the clutch release arms 226, the lever 146 continues its pivoting movement to reset the second and minute indicators to zero. Referring to FIG. 13, the reset function for the second hand is provided by means of a cam 230 shown formed on the perimeter of the sleeve 132, and a cooperating cam actuator 232 found on the three-position lever 146. The cam may be integrally formed on the sleeve, as shown, or attached thereto, as desired. The cam face is generally heart-shaped, and may be of cardioidal form, such that the cam cusp is nearest the cam axis, and the diagonally opposite point is furthest therefrom, with the cam surface gradually increasing in distance from the cam axis in going in either direction of the cusp to the point. The cooperating cam actuator 232 has a bladelike end engagable with the cam surface following disengagement of the clutch. It will be seen then, that upon actuation of the reset means 28, the pallet 94 is locked, the clutch 122 is released, and then the cam actuator 232 engages the cam 230 to return the cam to a rotary position wherein the actuator engages the cusp. The sweep second hand 38 attached to the sleeve 132 is thereby returned to its zero position when the stop watch is reset, and remains thereat so long as the lever 146 remains in said reset position.

The minute indicating dial 38 simultaneously is returned to zero position with the sweep second hand 36. As noted above, the drive arm end or gathering pawl 142 for moving the dial moves rearwardly when the clutch 122 is disengaged to avoid interfering with rotation of the minute dial during reset. The click 145 also is disengaged from the teeth 144 of the minute dial 38. As seen in FIG. 13 the click 145 is carried at the end of a resilient arm 240, the other end of which arm is integrally formed with the front plate 42. A click release arm 242 is formed on the arm 240 which extends into the path of rack portion 170 of the three-position lever 146. During return travel of the lever 146 under operation of the return spring 150, the rack 170 engages the release arm 242 to raise the click 145 from the wheel 38. After the click is released, continued pivotal movement of the lever 146 toward reset position functions to reset the minute indicator dial 38 to zero in a manner similar to the above-described resetting of the sweep second hand. In brief, a heart-shaped cam 244 is formed on the hub of the minute dial 38 which is engagable by a cooperating cam actuator 246 provided on the three-position lever 146. With the minute dial now free to rotate upon initial return pivotal movement of the lever, the cam actuator 246 engages the cam 244 to return the dial to zero during final return movement of the lever. The lever stops with both cam actuators 232 and 246 engaged with the cusps of the associated cams 230 and 244, respectively. From the FIG. 13 reset position, a timing cycle is initiated by actuation of the start stop actuating means 26 for pivotal movement of the lever 146 to the FIG. 11 position, in the manner described above.

In operation, the watch is wound by rotation of the winding crown 24 for rotation of the spring barrel 52. The outer end of the mainspring 50, which is coupled to the barrel through the clutch 56, is carried by the barrel until the spring is wound to a sufficient degree for slippage of the clutch within the barrel. The teeth 64 of the combination click and up down indicator 63 prevent rotation of the spring barrel during watch operation. An indication of the torque supplied by the main spring is provided by the position of indicator 65B along slot 42A in the front plate, and operation under low torque conditions is prevented by engagement of stop member 65C with the center wheel 80.

The other end of the mainspring 50 is fixed to the arbor 54 for driving rotation thereof in the run position of the start, stop and reset lever 146. The rotational force supplied by the spring 50 is transmitted through the arbor 54 and gears 66, 68, 72 and 74 to the center shaft 76 for drive rotation of the center wheel 80 attached thereto. In cluch engaged condition during run operation the center wheel 80 is connected by clutch 122 to the sweep second indicating means 36. Also, an axially movable gathering arm 142 carried by the driven clutch member 130 is engagable with teeth formed on the minute indicator 38 for step rotation thereof for each revolution of the indicator 36.

When running, the escape wheel 86 is driven by the center wheel 80 through a pinion 82. The speed of rotation of the escape wheel is limited by its cooperation with the pallet 94 which rocks back and forth clearing individual teeth of the wheel 86. Rocking motion of the pallet 94 attached to the balance staff 92 is governed by the balance wheel 100 rotatably supported on said balance staff and coupled thereto through the spring 96. Speed adjustment is provided by tilting the upper end of the staff 92 toward (for slower operation) or away (for speeding operation) from the escape wheel for adjustment of the depth of engagement of the pallet and escape wheel. Tilting movement of the balance staff is provided by extending the staff through intersecting slots formed in the top plate 42 and pivotally mounted adjusting plate 108.

The watch is stopped by actuation of the start stop actuating means 26 for camming action of surface 192A thereon along cam surface 196A formed on the lever 146. In the stop position finger 206 on bifurcated arm section 204 of the lever 146 engages the pallet 94 to stop the watch. For accumulated time operation, restarting and restopping without resetting is provided by time out mechanism 210 which serves to lift the finger 206 from the pallet, as desired.

For reset operation, the reset actuating means 28 is depressed to release the detent 176 from the rack 170 formed on the pivotal lever 146, thereby allowing the lever to pivot counterclockwise under operation of the spring 150. In pivoting between the stop and reset positions, the clutch 122 is actuated into disengaged condition by clutch release arms 226 formed on the lever 146. Simultaneously, the gathering pawl 142 pivots rearwardly out from alignment with teeth formed on the minute indicator 38. The click 145 is released by engagement of an arm 242 extending from click arm 240 with the back of the rack 170 as the lever 146 pivots toward reset position. During the final portion of the reset movement of the lever, cam actuators 232 and 246 thereon engage the cams 230 and 244 affixed to the second and minute indicating means 36 and 38, respectively, for return thereof to zero indicating position.

The watch is started by actuation of the start stop actuating means 26 for camming action of surface 192A thereon along cam surface 194A formed on the lever 146. The detent 176 engages the notch 172 in the rack 170 to maintain the lever in the run position. Upon release of the start stop actuating means 26 the camming end thereof rides up the cam 196 on the lever 146 and stops with the cam actuating surface 192A in position for engagement with cam surface 196A when the start stop actuating means is again depressed to stop the watch, in the manner described above.

The invention having been described in detail in accordance with the requirements of the Patent Statutes, various changes and modifications will suggest themselves to those skilled in this art, and it is intended that such changes and modifications shall fall within the spirit and scope of the invention as defined in the appended claims.

I claim:

1. In a resettable stop watch which includes driving means, a time train connecting the driving means to an escapement, a dial train, resettable time indicating means connected to said dial train, the improvement comprising, a normally engaged clutch for coupling the dial train to the time train, and clutch actuating means for disengaging the clutch during resetting of the time indicating means.

2. In a resettable stop watch as defined in claim 1, the improvement including, a unitary three-position start, stop and reset lever which includes said clutch actuating means for disengaging the clutch in the lever reset position.

3. In a resettable stop watch as defined in claim 2 the improvement wherein, said clutch includes a movable clutch plate driven by said time train and a driven clutch member in the dial train engageable by said movable clutch plate in the clutch engaged condition for drive rotation thereof, a zero return cam on said driven clutch member, and cam actuating means formed on said lever for engagement with said cam on said driven clutch member for return of the time indicating means to a zero position following disengagement of the clutch in movement of the lever from the stop to the reset position.

4. In a resettable stop watch as defined in claim 1 the improvement wherein, said time train includes a center gear and said clutch includes a movable clutch plate mounted on the center gear.

5. In a resettable stop watch as defined in claim 1 the improvement wherein, said time train includes a center gear coupled to said escapement to control the rate of movement of the center gear.

6. In a resettable stop watch as defined in claim 5 the improvement wherein, said clutch includes a movable clutch plate mounted on said center gear.

7. In a resettable stop watch which includes driving means, a time train connecting the driving means to an escapement, a dial train, resettable time indicating means connected to said dial train, the improvement comprising, a normally engaged clutch for coupling the dial train to the time train, clutch actuating means for disengaging the clutch during resetting of the time indicating means, a unitary three-position start, stop and reset lever which includes said clutch actuating means for disengaging the clutch in the lever reset position, a rack integrally formed on said lever and having first and second pawl engaging depressions, spring biasing means for urging said lever toward reset position at one end of lever travel, a resiliently biased pawl engagable with said depressions on the rack for holding the lever in start and stop positions against action of said spring biasing means, and a manually operated reset actuating means engagable with said pawl for releasing the same from said rack to release the lever for movement from the stop position to reset position under operation of said spring biasing means.

8. In a resettable stop watch which includes driving means, a time train connecting the driving means to an escapement, a dial train, resettable time indicating means connected to said dial train, the improvement comprising, a normally engaged clutch for coupling the dial train to the time train, clutch actuating means for disengaging the clutch during resetting of the time indicating means, a unitary three-position start, stop and reset lever which includes said clutch actuating means for disengaging the clutch in the lever reset position, and means forming a bifurcated arm on said lever which includes a pair of fingers engagable with the escapement in the stop and reset positions of the lever to stop watch operation.

9. In a resettable stop watch as defined in claim 8, the improvement including, manually actuatable time out means engagable with one finger of said bifurcated arm in the stop position of the lever for disengaging said one finger from said escapement for watch operation with the lever in the stop position to provide an indication of accumulated watch operating time.

10. In a resettable stop watch which includes driving means, a time train connecting the driving means to an escapement, a dial train, resettable time indicating means connected to said dial train, the improvement comprising, a normally engaged clutch for coupling the dial train to the time train, clutch actuating means for disengaging the clutch during resetting of the time indicating means, a unitary three-position start, stop and reset lever which includes said clutch actuating means for disengaging the clutch in the lever reset position, said clutch including a movable clutch plate driven by said time train and a driven clutch member in the dial train engagable by said movable clutch plate in the clutch engaged condition for drive rotation thereof, a zero return cam on said driven clutch member, cam actuating means formed on said lever for engagement with said cam on said driven clutch member for return of the time indicating means to a zero position following disengagement of the clutch in movement of the lever from the stop to the reset position, said time indicating means including a sweep second hand attached to said driven clutch member and a rotatable minute dial with teeth formed thereon, and a resilient gathering means including a generally radially extending gathering arm carried by said driven clutch member and engagable with said teeth on the minute dial for step rotation of the dial in the watch run condition, said gathering arm being movable generally axially out of alignment with said teeth in the clutch disengaged condition.

11. In a resettable stop watch as defined in claim 10, the improvement including, a zero return cam on said minute dial, and engagement with said cam on said minute dial following disengagement of the clutch and disalignment of the gathering arm with said dial teeth.

12. In a resettable stop watch as defined in claim 10 the improvement wherein, said resilient gathering means engages said clutch plate and follows said clutch plate during movement thereof between clutch engaged and disengaged conditions.

13. In a resettable stop watch as defined in claim 10 the improvement including, a top plate for support of the rotatable dial, a transparent fiducial plate integrally formed with the top plate and having a fiducial line thereon adjacent said rotatable dial, and indicia on the rotatable dial for minute indication in conjunction with the fiducial line on the transparent fiducial plate.

14. In a resettable stop watch as defined in claim 10 the improvement including, a click engagable with the teeth on the minute dial, and means formed on said lever for releasing said click from said dial during reset movement of said lever.

15. In a resettable stop watch which includes driving means, a time train connecting the driving means to an escapement, a dial train, resettable time indicating means connected to said dial train, the improvement comprising, a normal engaged clutch for coupling the dial train to the time train, clutch actuating means for disengaging the clutch during resetting of the time indicating means, a unitary three-position start, stop and reset lever which includes said clutch actuating means for disengaging the clutch in the lever reset position, first and second cams formed on said lever, and a manually operated start stop actuating means including a cam actuator formed with a cam actuating surface engagable with the first and second cams in the lever reset and lever start positions, respectively, for sequentially moving the lever from the reset to the start position and from the start to the stop position upon sequential actuation of said stop start actuating means.

16. In a resettable stop watch as defined in claim 15 wherein said start stop actuating means is reciprocally mounted and said cam actuator is slidable over said second cam during return movement of the start stop actuating means with the lever in the start position.

17. In a resettable stop watch as defined in claim 15 wherein said start stop actuating means includes a reciprocally mounted stem portion, a resilient loop connecting said cam actuator portion to said stem portion, cooperating shoulders formed on said cam actuator and stem portions engagable during manual actuation of said start stop actuating means to limit flexing of said loop in the direction of reciprocal motion.

18. In a resettable stop watch which includes driving means, a time train connecting the driving means to an escapement, a dial train, resettable time indicating means connected to said dial train, the improvement comprising, a normally engaged clutch for coupling the dial train to the time train, clutch actuating means for disengaging the clutch during resetting of the time indicating means, said time train including a center gear and said clutch including a movable clutch plate mounted on the center gear, said center gear being formed with a plurality of radially extending slots in one face thereof, and legs formed on said clutch plate ends slidably engagable with said slots in said center gear for movement therealong during clutch actuation.

19. In a stop watch which includes driving means, a time train connecting said driving means to an escapement, time indicating means connected to a dial train, a clutch connecting said dial train to said time train, the improvement comprising, a three position, unitary, pivotally mounted start, stop and reset lever for use in starting, stopping and resetting control of said watch, means for resiliently biasing said lever for pivotal movement thereof toward the reset position at one end of lever travel, start stop manually actuatable cam actuating means, a first cam surface on said lever engagable by said cam actuating means for moving said lever from the reset to the start position, a second cam surface on said lever also engagable by said manually actuatable cam actuating means for moving said lever from said start position to said stop position, means for releasably securing said lever in said start and stop positions against action of said resilient biasing means, and manually movable reset actuating means for releasing the releasable securing means for release of said lever for pivotal movement into reset position under operation of said resilient biasing means.

20. In a stop watch which includes drive means, first and second time indicating means, and a gear train connecting said drive means to said time indicating means, the improvement wherein, said first indicating means comprises a sweep second hand, said second indicating means comprises a rotatably mounted calibrated dial, a top plate beneath which said drive means is located and above which said time indicating means are located, and fixed reference means adjacent said dial for use in reading the same, said top plate being integrally fromed with a transparent plate above the level of the upper surface of the top plate upon which said fixed reference means is located.

21. In a stop watch which includes drive means, first and second time indicating means, and a gear train connecting said drive means to said time indicating means, the improvement wherein, said first indicating means comprises a sweep second hand, said second indicating means comprises a rotatably mounted calibrated dial, fixed reference means adjacent said dial for use in reading the same, a releasable clutch having an axially movable clutch plate for connecting said gear train to said time indicating means, teeth on said second indicating means, and a resilient gathering member having one end attached to said first indicating means and having an axially movable free end engagable with said teeth in the clutch engaged condition, said free end of the resilient gathering means being generally axially movable to a position out of alignment with said teeth in the clutch disengaged condition.

22. In a stop watch as defined in claim 21 wherein said resilient gathering means engages said movable clutch plate and follows the same during movement from clutch engaged to clutch disengaged condition and is driven thereby during movement from clutch disengaged to clutch engaged condition.

23. In a horological instrument, an escapement comprising a shaft, means rotatably supporting said shaft, an escape pallet fixed to said shaft, balance means rotatably mounted on the shaft, and spring means secured to said shaft and having diametrically opposite ends coupled to said balance means whereby rotatable movement of said balance means is transmitted to said pallet.

24. In a horological instrument, an escapement comprising a shaft, means rotatably supporting said shaft, an escape pallet fixed to said shaft, balance means rotatably mounted on the shaft, and spring means secured to said shaft and having diametrically opposite ends coupled to said balance means whereby rotatable movement of said balance means is transmitted to said pallet, said balance means including a wheel having a cylindrical shaped rim formed with diametrically opposite openings into which said spring ends extend for slidable engagement between said spring and balance means.

25. In the horological instrument as defined in claim 24 wherein said diametrically opposite openings formed in the balance wheel rim comprise slots having non-parallel facing walls for engagement with said spring.

26. In the horological instrument as defined in claim 25 wherein said diametrically opposite slots are formed with tapered side walls.

27. In the horological instrument as defined in claim 25 wherein said spring is of cylindrical cross-sectional shape for substantially point sliding engagement with said slot walls in the balance wheel.

28. In the horological instrument, an escapement comprising a shaft, means rotatably supporting said shaft, an escape pallet fixed to said shaft, balance means rotatably mounted on the shaft, spring means secured to said shaft and having diametrically opposite ends coupled to said balance means whereby rotatable movement of said balance means is transmitted to said pallet, a rotatable escape wheel having teeth engagable by said pallet, and means for tilting said rotatably supported shaft to which said pallet is fixed for adjusting the depth of engagement of the pallets with the escape wheel for speed regulation of the instrument.

29. In the horological instrument as defined in claim 28 wherein said tilting means includes intersecting slots formed in fixed and rotatably movable plates through which said shaft extends.

30. In a horological instrument, an improved escapement with speed regulating means comprising, a rotatable shaft, a pallet fixed to said shaft, a rotatably mounted escape wheel having teeth engagable by said pallet, and means for tilting said rotatable shaft in the direction of the escape wheel for adjusting the depth of engagement of the pallet with the escape wheel teeth for speed regulation.

31. In the horological instrument, an improved escapement with speed regulating means comprising, a rotatable shaft, a pallet fixed to said shaft, a rotatably mounted escape wheel having teeth engagable by said pallet, and means for tilting said rotatable shaft in the direction of the escape wheel for adjusting the depth of engagement of the pallet with the escape wheel teeth for speed regulation, said tilting means including a fixed plate having a slot therethrough which extends radially from the axis of rotation of said rotatably mounted escape wheel, a movable regulating plate adjacent said fixed plate and mounted for rotative movement about a fixed axis, said movable plate being formed with a slot which intersects said slot in said fixed plate, said rotatable shaft extending through the intersection of the slots for tilting movement of the shaft along the slots with rotary motion of the movable plate to thereby adjust the depth of engagement of the pallet with the escape wheel.

32. In the horological instrument as defined in claim 31 the improvement which includes a pointer carried by said rotatably movable regulating plate, a watch case and crystal closing the case, slot-fast indicia on said crystal past which said pointer is movable upon rotation of the regulating plate to provide a visual indication of the setting of the regulating means.

33. In the horological instrument as defined in claim 32 wherein said case is provided with a side wall formed with an opening therethrough for access to said movable regulating plate for rotating the same for speed regulation.

34. In a watch movement which includes a mainspring, time indicating means, and a gear train connecting the time indicating means to the mainspring for driving the same, the improvement comprising, a movable stop engagable with said gear train to stop watch operation, and means for moving said stop in accordance with the mainspring torque for stopping watch operation when the mainspring torque reduces below a predetermined level.

35. In a mechanical watch movement which includes a mainspring, the improvement comprising, a visible, movable, up down indicator resiliently biased for movement in one direction, and means for balancing force provided by mainspring torque against the resiliently biased up-down indicator for movement of said indicator in an amount related to the mainspring torque for visual indication of said torque over a range of mainspring torque.

36. In the mechanical watch movement as defined in claim 35 wherein said up down indicator comprises a mainspring winding click.

37. In a mechanical watch movement which includes a barrel, a mainspring within the barrel, means including a gear train for connecting said mainspring to time indicating means for drive operation thereof, and a barrel click engagable with teeth formed on the barrel for limiting relative barrel and click rotation to one rotary direction, the improvement comprising, means for resiliently mounting said click for movement radially of the barrel for passage over barrel teeth during winding of the mainspring and for limited tangential movement thereof in an amount which is a function of the mainspring torque.

38. In a mechanical watch movement which includes a barrel, a mainspring within the barrel, means including a gear train for connecting said mainspring to time indicating means for drive operation thereof, and a barrel click engagable with teeth formed on the barrel for limiting relative barrel and click rotation to one rotary direction, the improvement comprising, means for resiliently mounting said click for movement radially of the barrel for passage over barrel teeth during winding of the mainspring and for limited tangential movement thereof in an amount dependent upon the mainspring torque, and an up down indicator on said click for visual indication of the mainspring torque.

39. In a mechanical watch movement as defined in claim 38 including, means for limiting said indicator to reciprocal movement under control of the tangential movement of said click.

40. In a mechanical watch movement which includes a barrel, a mainspring within the barrel, means including a gear train for connecting said mainspring to time indicating means for drive operation thereof, and a barrel click engagable with teeth formed on the barrel for limiting relative barrel and click rotation to one rotary direction, the improvement comprising, means for resiliently mounting said click for movement radially of the barrel for passage over barrel teeth during winding of the mainspring and for limited tangential movement thereof in an amount dependent upon the mainspring torque, an up-down indicator on said click for visual indication of the mainspring torque, and a stop member on said click for interference with the gear train to stop watch operation when the mainspring torque reduces to a predetermined level.

41. In a machanical watch movement which includes a barrel, a mainspring within the barrel, means including a gear train for connecting said mainspring to time indicating means for drive operation thereof, and a barrel click engagable with teeth formed on the barrel for limiting relative barrel and click rotation to one rotary direction, the improvement comprising, means for resiliently mounting said click for movement radially of the barrel for passage over barrel teeth during winding of the mainspring and for limited tangential movement thereof in an amount dependent upon the mainspring torque, and a stop member on said click for interference with the gear train to stop watch operation when the mainspring torque reduces below a predetermined level.

42. In a mechanical watch movement which includes a barrel, a mainspring within the barrel, means including a gear train for connecting said mainspring to time indicating means for drive operation thereof, and a barrel click engagable with teeth formed on the barrel for limiting relative barrel and click rotation to one rotary direction, the improvement comprising, means for resiliently mounting said click for movement radially of the barrel for passage over barrel teeth during winding of the mainspring and for limited tangential movement thereof in an amount dependent upon the mainspring torque, and said resilient mounting means includes an elongated spring having opposite fixed and free ends and formed with an arcuate section therein, the size of which varies depending upon the mainspring torque.

43. In a mechanical watch movement as defined in claim 42 including, a top plate to which one end of the elongated spring is secured, an up down indicator on the elongated spring, and means forming an elongated aperture in the top plate through which said up down indicator extends in sliding relation therewith.

44. In a mechanical watch movement as defined in claim 43 wherein said up down indicator is located adjacent the free end of the elongated spring and the click is located intermediate the up down indicator and fixed end of the spring.

45. A mechanical watch movement which includes a barrel, a spiral mainspring within the barrel and having inner and outer ends, an arbor to which the inner end of the spring is attached, and a clutch connecting the mainspring to the barrel, the improvement wherein said clutch comprises a generally C-shaped spring member, the outer end of the mainspring being formed with an outwardly directed hook into which one end of the spring member extends for positive rotative pushing engagement of the clutch by the mainspring in one relative direction of rotation thereof, said clutch being slidably engaged with said barrel for preventing overwinding of the mainspring.

46. A mechanical watch movement as defined in claim 45, the improvement wherein, said spring member is formed with a generally inwardly directed end portion at the one end thereof extending into said hook portion formed at the outer end of the mainspring.

47. A mechanical watch movement as defined in claim 45 wherein clutch is formed of stiffer spring material than said mainspring and which, in the unrestrained condition, forms an arc of greater radius than the radius of the barrel within which the clutch is carried, said barrel being formed with a smooth inner cylindrical surface for said slidable engagement with the clutch.

48. In a resettable stop watch which includes driving means, a time train connecting the driving means to an escapement, a dial train, resettable time indicating means connected to said dial train, a normally engaged clutch for coupling the dial train to the time train, clutch actuating means for disengaging the clutch during resetting the time indicating means, a three-position start, stop and reset lever which includes said clutch actuating means for disengaging the clutch in the lever reset position, and spring biasing means for urging said lever toward reset position at one end of lever travel, the improvement comprising, means for mounting said lever for pivotal rotation about a post, and wherein, said spring biasing means comprises a leaf spring which engages said lever and formed with a laterally extending portion overlying said lever to prevent disengagement thereof from said mounting post.

49. In a horological instrument which includes a mainspring, a time train connecting one end of the mainspring to an escapement, winding mechanism including a wheel connecting the other end of the mainspring to a winding stem, a winding click engagable with teeth on the wheel for limiting relative wheel and click rotation to one rotary direction, the improvement comprising, resilient biasing means, means including said resilient biasing means for mounting said winding click for limited movement along a path extending generally tangentially of said wheel whereby force provided by mainspring torque on said click is opposed by said resilient biasing means, and up down indicating means on said winding click to provide a visual indication of mainspring torque.

* * * * *